United States Patent [19]

Nigrelli

[11] Patent Number: 4,625,864

[45] Date of Patent: Dec. 2, 1986

[54] CONTAINER PACKAGE ASSEMBLY

[76] Inventor: Terry J. Nigrelli, 11117 Marken Rd., Kiel, Wis. 53042

[21] Appl. No.: 768,874

[22] Filed: Aug. 23, 1985

[51] Int. Cl.[4] ..... B65D 71/04

[52] U.S. Cl. ..... 206/427; 206/442

[58] Field of Search ..... 53/48; 206/139, 201, 206/203, 45.31, 45.34, 427, 428–435, 443, 446, 521, 442; 229/30, 31 R, 32, 28 R

[56] References Cited

U.S. PATENT DOCUMENTS

| | | | |
|---|---|---|---|
| 3,338,406 | 8/1967 | Anderson | 206/432 |
| 3,485,355 | 12/1969 | Stewart | 206/427 |
| 3,650,395 | 3/1972 | Hobbs | 206/432 |

FOREIGN PATENT DOCUMENTS

| | | | |
|---|---|---|---|
| 0030321 | 10/1959 | Finland | 206/427 |

*Primary Examiner*—George E. Lowrance
*Assistant Examiner*—Jimmy G. Foster
*Attorney, Agent, or Firm*—Fuller, House & Hohenfeldt

[57] ABSTRACT

Disclosed herein is a container package assembly employing upper and lower trays with a shallow depth which are positioned on the ends of the container and secured in assembly about the containers with cross strapping. When used with P.E.T. bottles, the upper tray is shorter and narrower than the lower tray and is engaged about the neck flanges of the P.E.T. bottles which positively position the upper tray with respect to the lower tray. This assembly provides a low cost efficient package for shipping and handling and displays the container label.

2 Claims, 5 Drawing Figures

CONTAINER PACKAGE ASSEMBLY

BACKGROUND OF INVENTION

The invention relates to a bottle or can package assembly involving upper and lower spaced trays which are secured by banding or strapping material.

This patent is a further development of the subject matter of U.S. Pat. No. 4,531,345 which is incorporated herein by reference. That patent discloses equipment for packaging the recently developed P.E.T. bottles made from polyethylene terepthalate. These bottles are formed with pronounced laterally extending neck flanges. In the foregoing patent the flanges cooperate with various guide and support means to assist in handling the bottles during loading. The present invention in its most specific applications relates to utilizing the laterally extending flanges of the P.E.T. bottles to center and positively locate an upper tray which is part of an upper and lower tray assembly.

Although two-piece cases or cartons are old as illustrated by U.S. Pat. Nos. 2,885,137; 3,425,544; 3,058,643; and 3,743,167, none of these patents use the articles themselves or the article necks as a centering or positioning device to positively position a smaller upper tray at a predetermined position with respect to the lower tray.

SUMMARY OF INVENTION

The invention provides a carton assembly for confining and facilitating shipping and handling of containers particularly P.E.T. bottles. The assembly uses an upper tray which is shorter in length and narrower in width than the lower tray to snugly embrace the neck flanges of the bottles. The bottles positively position the upper tray with respect to the lower tray to facilitate combining the trays in integrated assembly with strapping tape or banding material. The upper tray is sized relative to the number of bottles in transverse and longitudinal rows and the inside width and length of the trays are related to the radius or diameter of the bottles and the radius of the neck flanges which engage the depending flaps of the upper tray.

A particular feature of the invention is to use very shallow trays and depend on the integrated assembly of the upper and lower tray and strapping to rigidify the assembly and provide structural integrity using the containers themselves as part of the assembly structure. This minimizes the amount of paper board material required in the trays and reduces the overall expense as compared to other forms of packing such as the deep cartons illustrated in U.S. Pat. No. 4,531,345. Use of shallow trays also results in visibility of the decorative labels and trademarks on the bottles or containers which commonly contain beverages. Hence, the trays themselves do not have to be printed saving additional packaging expense. The tray assembly of the invention provides for convenient and inexpensive handling of bottles between the bottle filling station and the point of purchase and also provide convenient handling for customers who purchase the product at the retail establishment.

Further objects and features of the invention will become apparent from the disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
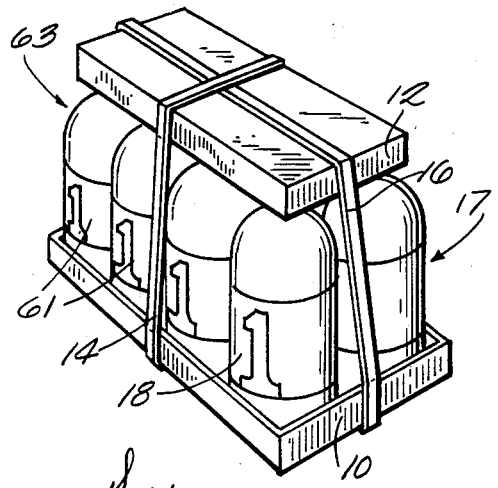
FIG. 1 is a perspective view of a shipping carton assembly in accordance with the invention.
Figure 2:
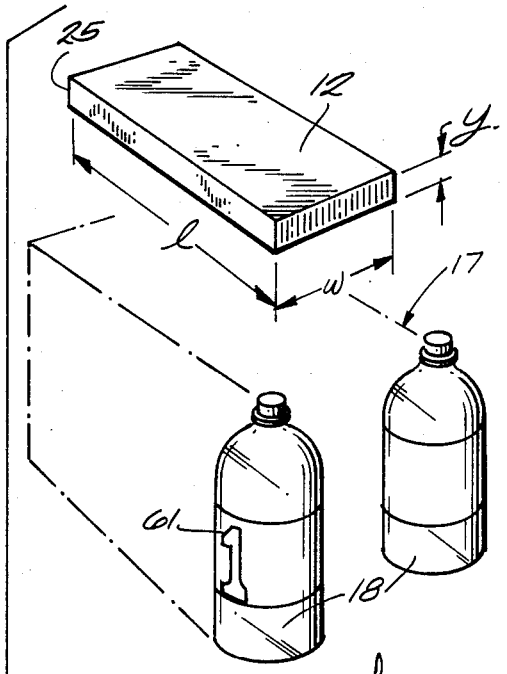
FIG. 2 is an exploded view of the upper and lower trays, together with bottles that go therebetween.

As illustrated in FIG. 1, the shipping container assembly of the invention includes a lower tray 10, upper tray 12 and banding or strapping material 14 and 16 which secures the upper and lower trays in embracing and confining relationship about a complement 17 of bottles 18 located therebetween.

Figure 3:
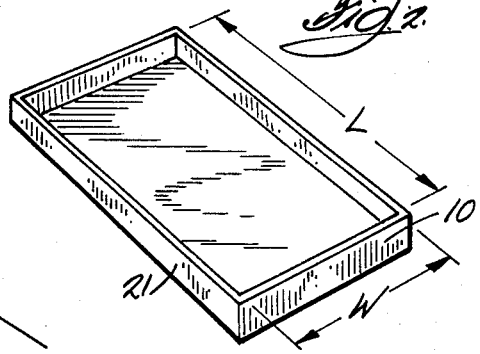
FIG. 3 is an enlarged sectional view of the assembly shown in FIG. 1.
Figure 3:
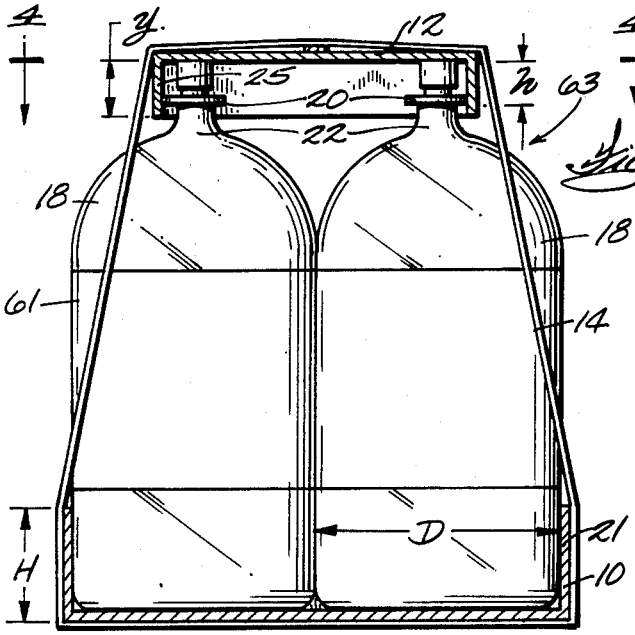

In the disclosed construction the containers 18 are P.E.T. bottles which as best illustrated in FIG. 3 contain a pronounced laterally extending neck flange 20 associated with the neck 22. To ensure that the assembly of upper and lower trays is rigid so that it will not come apart in use, the upper and lower trays desirably fit snugly about the containers. The bottles may be shoehorned into the trays by blades as illustrated in U.S. Pat. No. 4,391,078.

Where P.E.T. bottles are involved, the sizing of the inside of the lower tray 10 requires an inside width W substantially the same as the number of containers designated as n times the diameter D of the bottles where n is the number of containers in a transverse row. The width actually can be slightly less than twice the diameter of the two bottles illustrated in FIG. 3 to provide a tight fit resulting in the slight expansion of the upstanding flanges 21 of the lower tray 10. Similarly the inside length L of the lower tray will be equal to or substantially the same as N (number of containers in longitudinal direction) times D. The height H of the flange 21 is desirably below the bottom of the label 61 to provide a continuous window 63 surrounding the package between the upper and lower trays to display the label.

Figure 5:
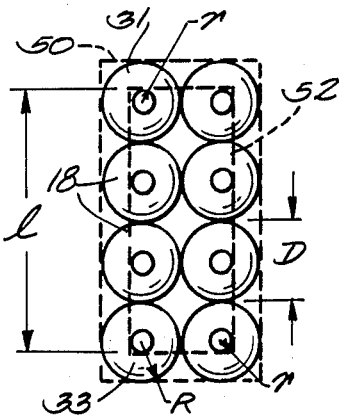
FIG. 5 is a diagrammatic plan view of the containers, and the dimensional relationships involved in sizing and dimensioning the trays.

The sizing or dimensioning of the inside of the upper tray 12 includes consideration of the depth Y of the upper tray and the distance from the bottom of the flange 20 to the top of the cap of the bottle as illustrated in FIG. 3. The depth Y desirably is equal to or greater than the depth h so that the depending flange 25 will engage and go beyond the neck flange 20 when inverted in the assembled position illustrated in FIGS. 1 and 3. This insures contact with the flange which is utilized to positively position the upper tray prior to integrating the trays with the banding material. The sizing of length 1 which is the inside length of the upper tray 12 includes consideration of the radius of the neck flange 20. The length 1 will include the radius R of the two end containers 31 and 33 or one diameter D as illustrated in FIG. 5 and the diameter of the number of containers N in the longitudinal row less 1. This relationship can be given by the equation:

Length 1 is substantially the same as $(N-1)\times D+2r$.

Figure 4:
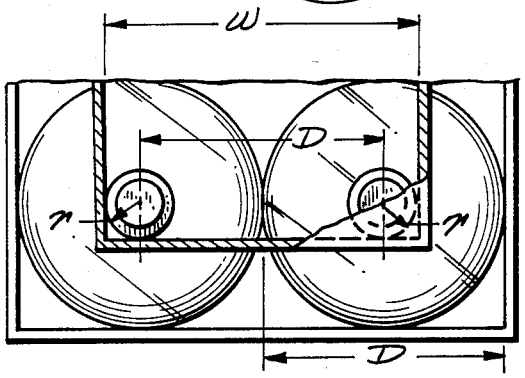
FIG. 4 is a view along line 4—4 of FIG. 3.

The width w as illustrated in FIG. 4 will include the diameter D or the radius of two container sidewalls plus 2r. This can be given by the equation:

W is substantially the same as $(n-1)\times D+2r$.

The inside dimensions 1 and w of the tray can be slightly less than these dimensions so that there is a press fit of the upper tray against the flanges of the neck.

The outline of the lower tray 10 is illustrated by broken line 50 in FIG. 5 and the outline of the upper tray 1 is illustrated by broken line 52.

The strapping or banding can include more than one band in both the transverse and longitudinal direction and can be applied by known banding equipment.

I claim:

1. The combination of a plurality of containers having annular neck flanges and tops and upper and lower trays and means to secure the upper and lower trays in spaced position to secure said components in integrated assembly, the number of containers in a transverse row being defined by the letter n and wherein d is the diameter of the containers, r is the radius of the neck flange, and N is the number of containers in a longitudinal direction and h is the height from the neck flange to the container top, said upper tray having a width w substantially the same as $(n-1)\times D+2r$ and a length l substantially the same as $(N-1)\times D+2r$ and a tray depth y greater than or equal to the height h of the flange to container top;

and wherein the dimensions of the lower tray include a width W substantially the same as $n\times D$ and a length L substantially the same as $N\times D$.

2. The combination of claim 1, wherein the means to secure the upper and lower trays in spaced position comprises strapping or bading material running in both the longitudinal and transverse direction.

* * * * *